US008290200B2

(12) United States Patent
Chen

(10) Patent No.: US 8,290,200 B2
(45) Date of Patent: Oct. 16, 2012

(54) DIAPHRAGM AND MICRO-ELECTROACOUSTIC DEVICE INCORPORATING THE SAME

(75) Inventor: Hwang-Miaw Chen, Taipei Hsien (TW)

(73) Assignee: Foxconn Technology Co., Ltd., Tu-Cheng, New Taipei (TW)

( * ) Notice: Subject to any disclaimer, the term of this patent is extended or adjusted under 35 U.S.C. 154(b) by 360 days.

(21) Appl. No.: 12/561,225

(22) Filed: Sep. 16, 2009

(65) Prior Publication Data

US 2010/0310110 A1 Dec. 9, 2010

(30) Foreign Application Priority Data

Jun. 8, 2009 (CN) ..... 2009 1 0303056

(51) Int. Cl.
*H04R 25/00* (2006.01)

(52) U.S. Cl. ..... 381/423; 381/420; 381/424; 381/430; 381/433

(58) Field of Classification Search ..... 381/396, 381/398, 403, 405, 420, 423–424, 430, 433, 381/426; 181/173, 174, 164, 165
See application file for complete search history.

(56) References Cited

U.S. PATENT DOCUMENTS

| | | | | |
|---|---|---|---|---|
| 3,342,286 | A * | 9/1967 | Staffen | 181/164 |
| 6,697,496 | B2 * | 2/2004 | Frasl | 381/398 |
| 7,306,073 | B2 * | 12/2007 | Frasl | 181/173 |
| 7,567,684 | B2 * | 7/2009 | Ono et al. | 381/424 |
| 2001/0010725 | A1 * | 8/2001 | Frasl | 381/150 |
| 2007/0047757 | A1 * | 3/2007 | Yang et al. | 381/423 |
| 2007/0053547 | A1 * | 3/2007 | Ando | 381/430 |
| 2011/0158463 | A1 * | 6/2011 | Goller | 381/423 |
| 2011/0194724 | A1 * | 8/2011 | Watanabe et al. | 381/398 |

* cited by examiner

*Primary Examiner* — Curtis Kuntz
*Assistant Examiner* — Jasmine Pritchard
(74) *Attorney, Agent, or Firm* — Altis Law Group, Inc.

(57) ABSTRACT

A diaphragm includes a central portion in a center of the diaphragm and an external portion surrounding the central portion. The central portion includes a central section in a center of the central portion, a peripheral section at an outer periphery of the central portion and a connecting section between the central section and the peripheral section. The peripheral section forms at least one protrusion.

8 Claims, 4 Drawing Sheets

DIAPHRAGM AND MICRO-ELECTROACOUSTIC DEVICE INCORPORATING THE SAME

BACKGROUND

1. Technical Field

The present invention relates generally to a micro-electroacoustic device, and more particularly to a diaphragm of a micro-electroacoustic device.

2. Description of Related Art

Sound is one important means by which people communicate with each other; thus, creating new methods for sound transference allows greater communication between people. Electroacoustic transducers are key components in transferring sound. A typical electroacoustic transducer has a magnetic circuit in which a magnetic field generated by a magnet passes through a base member, a magnetic core and a diaphragm and returns to the magnet again. When an oscillating electric current is supplied to a coil wound around the magnetic core, the corresponding oscillating magnetic field generated by the coil is then superimposed onto the magnetostatic field of the magnetic circuit. The resulting oscillation generated in the diaphragm is then transmitted to the air as sound. The basic loudspeaker, in which electric energy is converted to acoustic energy, is a typical electroacoustic transducer. There are many different types of loudspeakers, including electrostatic loudspeakers, piezoelectric loudspeakers, and moving-coil loudspeakers.

Nowadays, mobile phones are widely used and loudspeakers are important components packaged within the mobile phones. As design style for the mobile phones emphasizes lightness, thinness, shortness, smallness, energy-efficiency, low cost, the space available for the loudspeakers within the mobile phones is therefore limited. Furthermore, a rigidity of the diaphragm of the loudspeaker needs to increase for decreasing a radial movement during oscillation.

For the foregoing reasons, therefore, there is a need in the art for a diaphragm which can meet the requirements set forth above.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
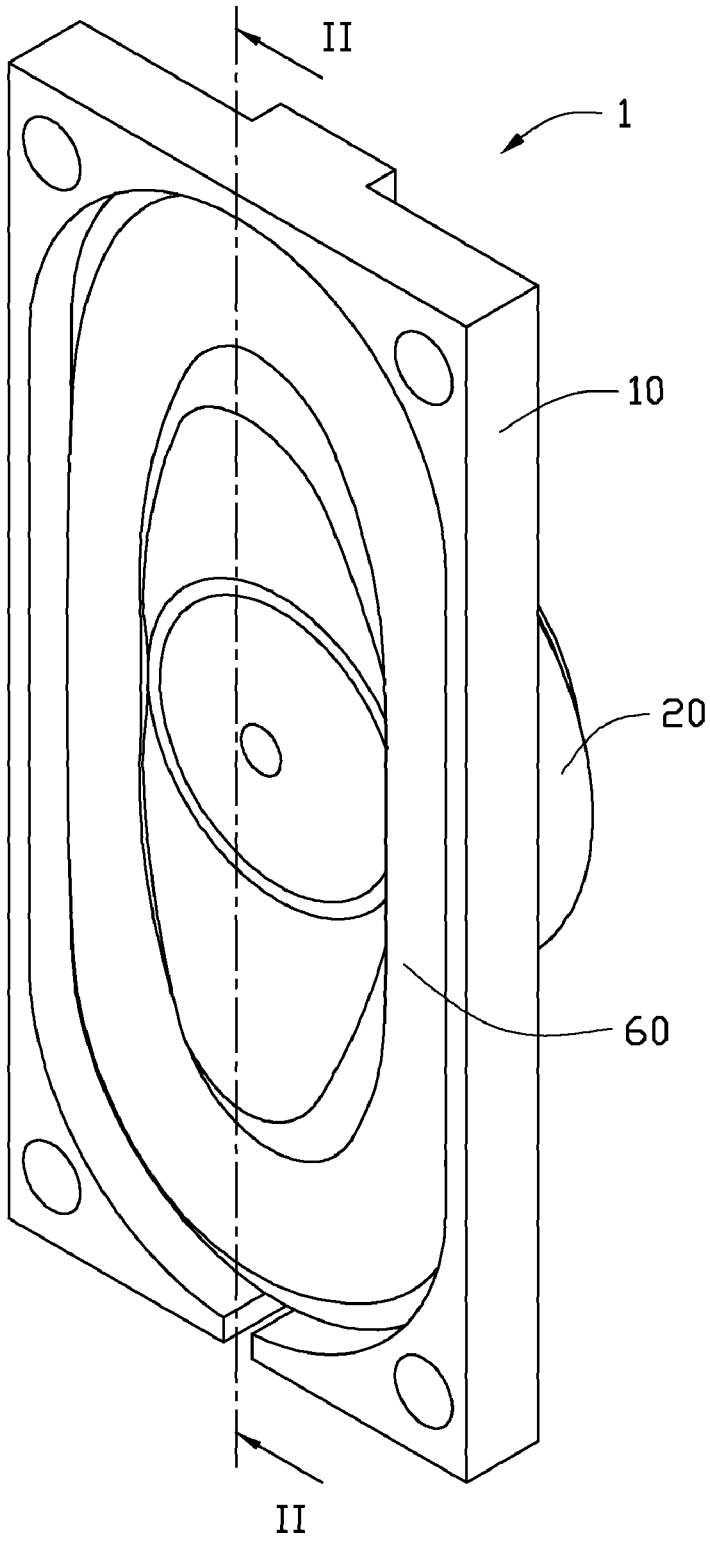
FIG. 1 is an isometric view of a micro-electroacoustic device according to an exemplary embodiment.
Figure 2:
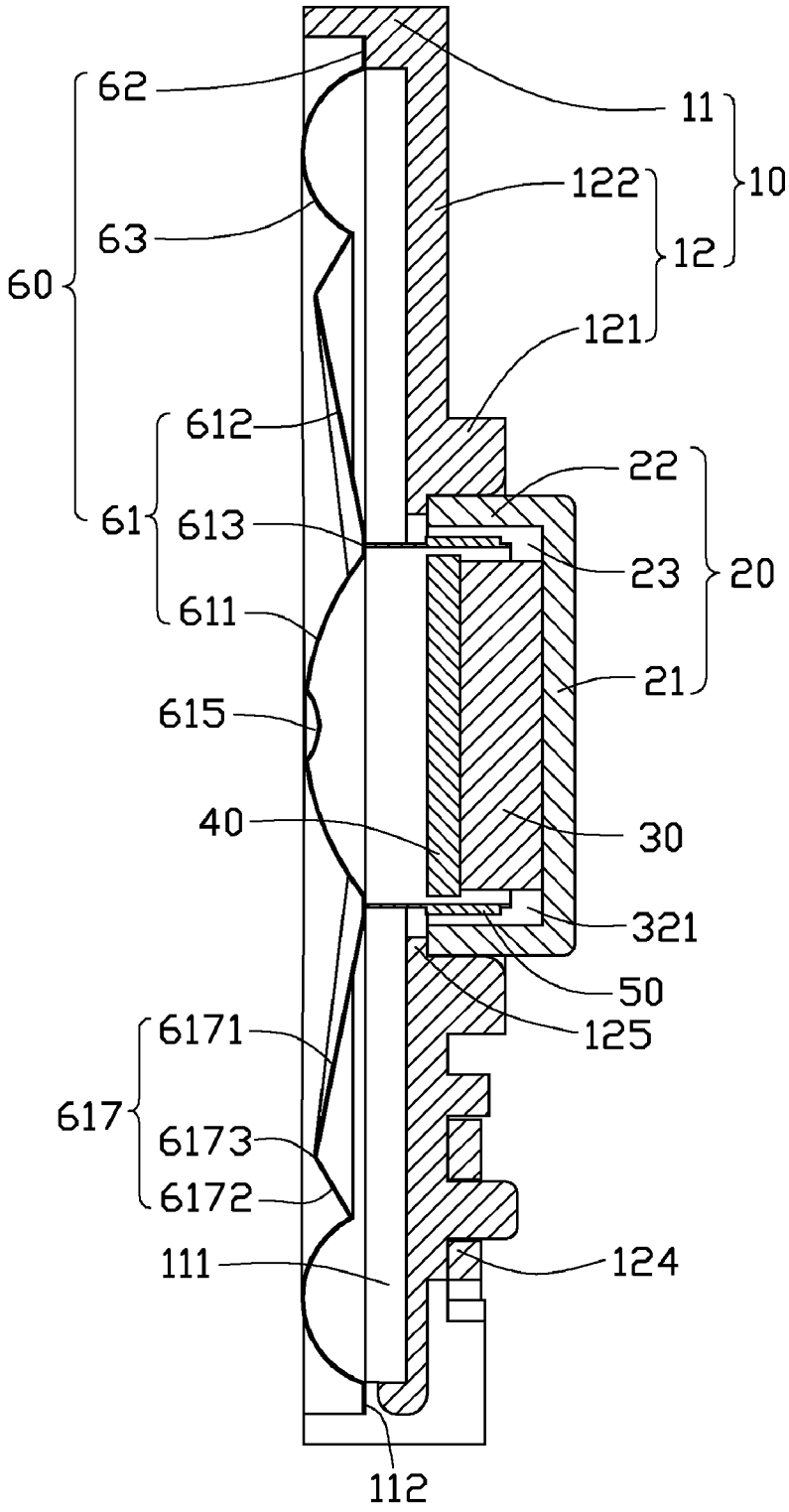
FIG. 2 is a cross-sectional view of the micro-electroacoustic device of FIG. 1, taken along line II-II thereof.

Referring to FIGS. 1-2, a micro-electroacoustic device 1 includes a housing 10, a cylindrical yoke 20 engaged with the housing 10, a disc-shaped magnet 30 disposed in the cylindrical yoke 20, a circular film-shaped washer 40 located on the magnet 30, a hollow cylinder-shaped coil 50 surrounding the magnet 30 and an elongated, film-shaped diaphragm 60 attached to the housing 10.

Figure 3:
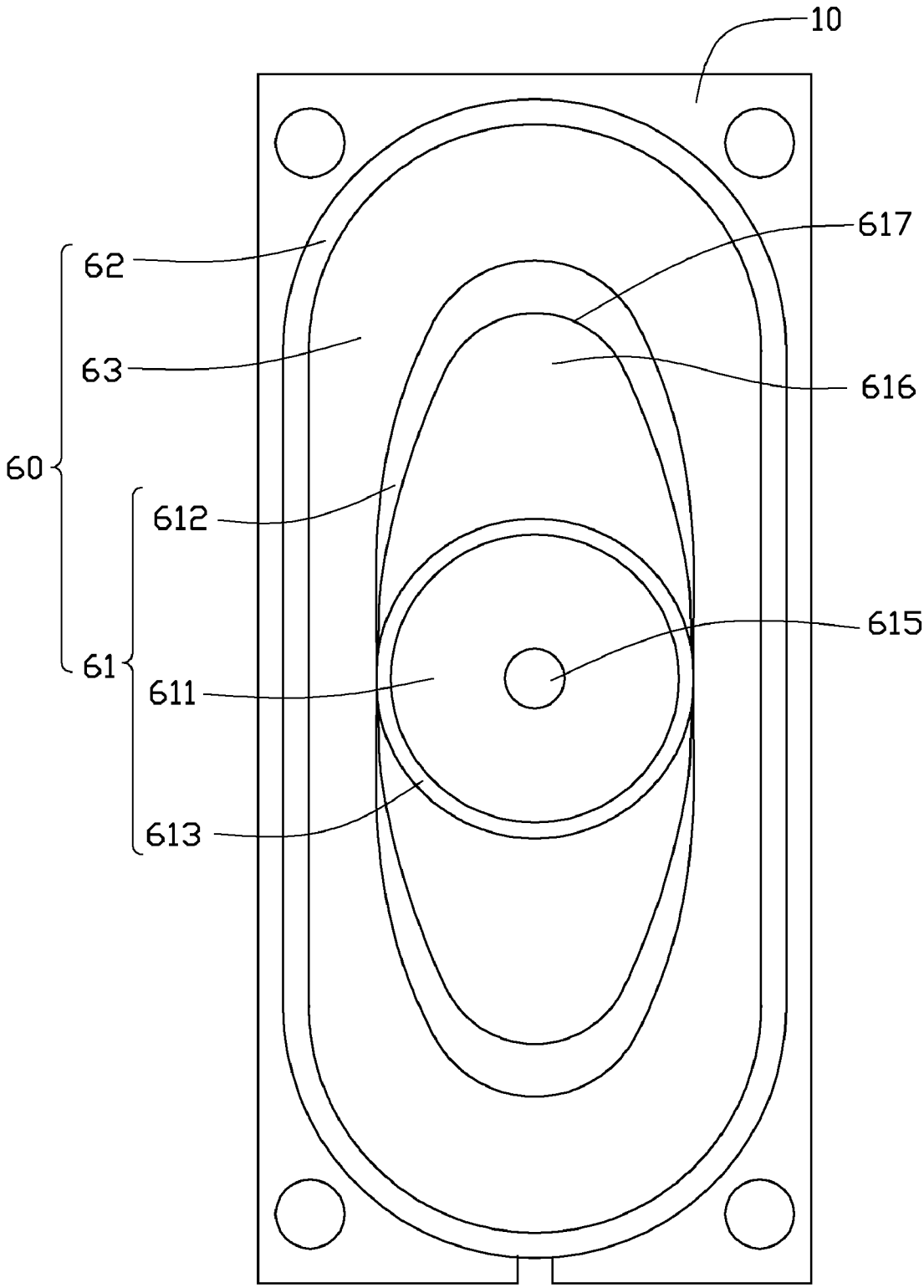
FIG. 3 is a front, plan view of the micro-electroacoustic device of FIG. 1.
Figure 4:
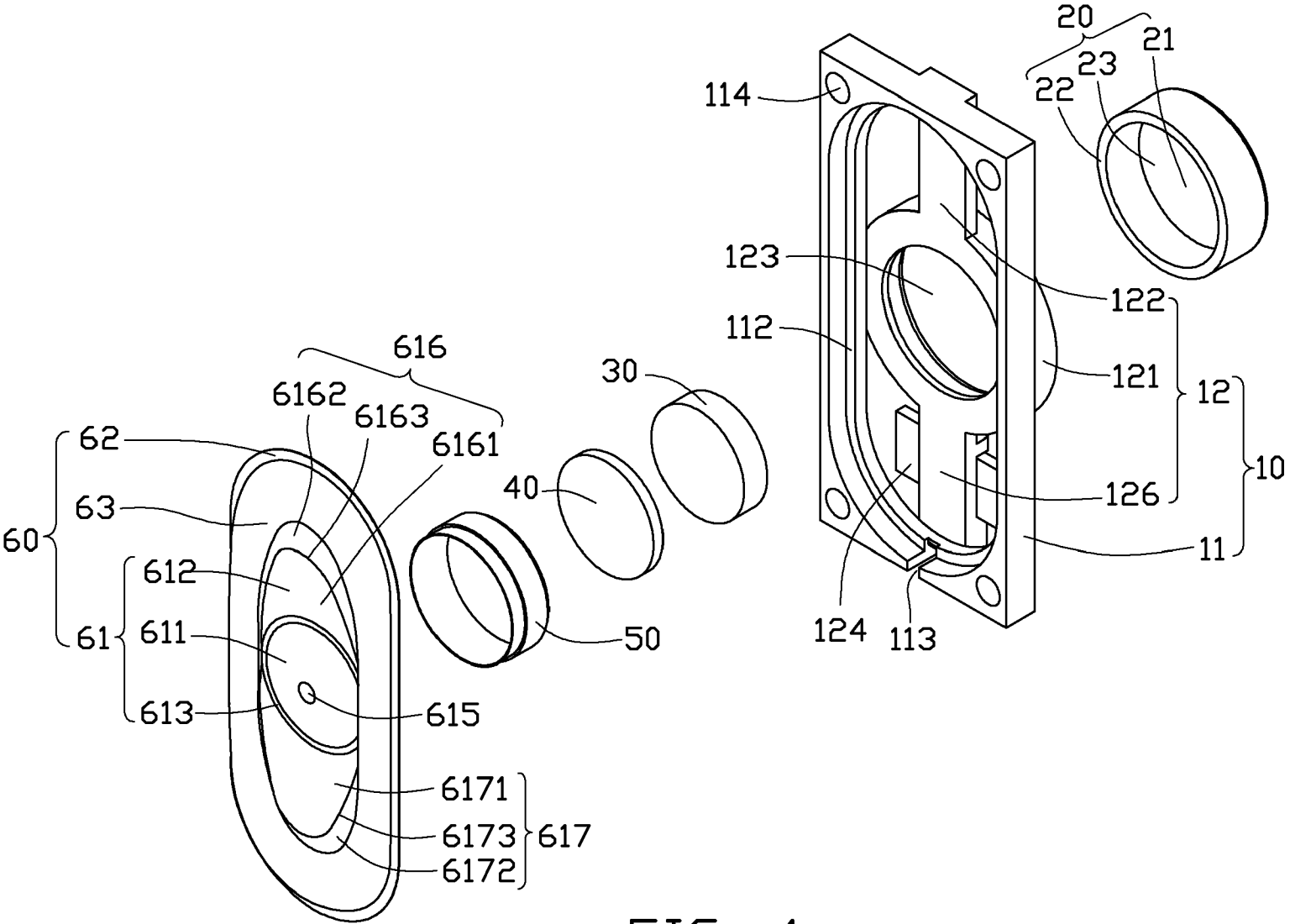
FIG. 4 is an exploded view of the micro-electroacoustic device of FIG. 1.

Referring also to FIGS. 3-4, the housing 10 includes a base plate 12 and a sidewall 11 located on the base plate 12. The sidewall 11 defines a receiving chamber 111 therein. The receiving chamber 111 is elongated with arced top and bottom ends. An annular step 112 is formed at an inner peripheral surface of the sidewall 11 and extends radially and inwardly from the inner peripheral surface of the sidewall 11 towards the receiving chamber 111. Each corner of the sidewall 11 defines a mounting hole 114 for mounting the micro-electroacoustic device 1 onto an electronic device such as a mobile phone or a notebook computer (not shown). A groove 113 is defined in a bottom side of the sidewall 11 for receiving electrical lines (not shown) of the micro-electroacoustic device 1.

The base plate 12 is integrally formed with the sidewall 11. The base plate 12 includes a hollow cylinder-shaped seat 121, a top arm 122 connecting the seat 121 with a top side of the sidewall 11, and a bottom arm 126 opposite to the top arm 122 and connecting the seat 121 with the bottom side of the sidewall 11. A central axis of the seat 121 is coaxial with a central axis of the sidewall 11. Two opposite lateral sides of the seat 121 are attached to the sidewall 11 and an outer diameter of the seat 121 is the same as a width of the sidewall 11. The seat 121 defines a through hole 123 therein. An annular protrusion 125 extends radially and inwardly from an inner peripheral surface of the seat 121. The top arm 122 extends upwardly from an outer peripheral surface of the seat 121 to the top side of the sidewall 11. The bottom arm 126 extends downwardly from the outer peripheral surface of the seat 121 to the bottom side of the sidewall 11. A printed circuit board 124 is attached to a rear surface of the bottom arm 126.

The cylindrical yoke 20 includes a circular base wall 21 and a side wall 22 extending upwardly from an outer edge of the base wall 21. The cylindrical yoke 20 defines a receiving space 23 therein. The cylindrical yoke 20 is received in the through hole 123 of the seat 121 and a front end of the side wall 22 rests on the protrusion 125 of the seat 121. The through hole 123 of the seat 121 communicates with the receiving space 23 of the cylindrical yoke 20.

The magnet 30 and the washer 40 are coaxially received in the receiving space 23 of the cylindrical yoke 20. The magnet 30 is mounted on the base wall 21 of the cylindrical yoke 20. The washer 40 is mounted on the magnet 30. An inner diameter of the cylindrical yoke 20 is larger than an outer diameter of the magnet 30 and an outer diameter of the washer 40, whereby the side wall 22 of the cylindrical yoke 20, an outer peripheral surface of the magnet 30 and an outer peripheral surface of the washer 40 define an annular air space 321 therebetween for accommodating the coil 50. The coil 50 surrounds the magnet 30 and the washer 40 and is movable in the annular air space 321.

The diaphragm 60 is elongated with arced top and bottom ends. The diaphragm 60 includes a central portion 61 in the center thereof, an external portion 63 surrounding the central portion 61 and an annular flange 62 extending radially and outwardly from an outer peripheral edge of the external portion 63. The flange 62 of the diaphragm 60 is attached to the step 112 of the sidewall 11 for fixing the diaphragm 60 onto the housing 10.

The external portion 63 has a profile of a stadium track and has a semicircular-shaped cross section. The central portion 61 includes a dome-shaped central section 611 in a center of the central portion 61, a peripheral section 612 at an outer periphery of the central portion 61 and an annular connecting section 613 connected between the central section 611 and the peripheral section 612. The central section 611 defines a spherical recess 615 in a center thereof. Thus, the dome-shaped central section 611 and the spherical recess 615 of the central section 611 improve a rigidity of the diaphragm 60 thereby preventing the diaphragm 60 from abrupt and huge deformation during vibration. The connecting section 613 extends radially and outwardly from an outer edge of the central section 611. A front side of the coil 50 is attached to a rear surface of the connecting section 613 of the diaphragm 60.

The peripheral section 612 includes a top protrusion 616 at a top side of the central section 611 and a bottom protrusion 617 at a bottom side of the central section 611. The top protrusion 616 includes a first sloping segment 6161, a second sloping segment 6162 and a ridge 6163 at a joint between the first and second sloping segments 6161, 6162 of the top protrusion 616. The first sloping segment 6161 of the top protrusion 616 extends upwardly and outwardly from the connecting section 613 to the ridge 6163. The second sloping segment 6162 of the top protrusion 616 extends downwardly and outwardly from the ridge 6163 to the external portion 63. The second sloping segment 6162 of the top protrusion 616 has a larger inclined angle than the first sloping segment 6161 of the top protrusion 616.

The bottom protrusion 617 includes a first sloping segment 6171, a second sloping segment 6172 and a ridge 6173 at a joint between the first sloping segment 6171 and the second sloping segment 6172 of the bottom protrusion 617. The first sloping segment 6171 of the bottom protrusion 617 extends upwardly and outwardly from the connecting section 613 to the ridge 6173. The second sloping segment 6172 of the bottom protrusion 617 extends downwardly and outwardly from the ridge 6173 to the external portion 63. The second sloping segment 6172 of the bottom protrusion 617 has a larger inclined angle than the first sloping segment 6171 of the bottom protrusion 617.

The top protrusion 616 and the bottom protrusion 617 increase a rigidity of the diaphragm 60 thereby preventing the diaphragm 60 from abrupt deformation during vibration and decreasing a radial vibration of the diaphragm 60 to improve a sound quality of the micro-electroacoustic device 1. Moreover, a low frequency characteristic of the micro-electroacoustic device 1 is in harmony with a high frequency characteristic of the micro-electroacoustic device 1 since the second sloping segments 6162, 6172 of the top and bottom protrusions 616, 617 each have a larger inclined angle than the first sloping segments 6161, 6171 of the top and bottom protrusions 616, 617.

It will be obvious that, within the scope of the invention, many variations are possible to those skilled in the art. The scope of protection of the invention is not limited to the example given herein.

What is claimed is:

1. A micro-electroacoustic device comprising:

a housing;

a magnet received in the housing;

a coil surrounding the magnet; and a diaphragm attached to the housing, the diaphragm comprising:

a central portion in a center of the diaphragm, the central portion comprising a central section in a center of the central portion, a peripheral section at an outer periphery of the central portion, and a connecting section between the central section and the peripheral section, the peripheral section forming at least one protrusion, the coil being attached to a rear surface of the connecting section of the central portion; and an external portion surrounding the central portion a seat protrusion extending radially and inwardly from an inner peripheral surface of a seat.

2. The micro-electroacoustic device as claimed in claim 1, wherein the at least one protrusion comprises two opposite protrusions symmetrically disposed at two opposite sides of the central section.

3. The micro-electroacoustic device as claimed in claim 2, wherein each of the protrusions comprises a first sloping segment, a second sloping segment and a ridge at a joint between the first and second sloping segments, the first sloping segment extending upwardly and outwardly from the connecting section to the ridge, the second sloping segment extending downwardly and outwardly from the ridge to the external portion.

4. The micro-electroacoustic device as claimed in claim 3, wherein the second sloping segment of each protrusion has a larger inclined angle than the first sloping segment of each protrusion.

5. The micro-electroacoustic device as claimed in claim 1, wherein the central section is dome-shaped and defines a spherical recess in a center thereof.

6. The micro-electroacoustic device as claimed in claim 1, wherein the external portion has a profile of a stadium track and has a semicircular-shaped cross section.

7. The micro-electroacoustic device as claimed in claim 1, wherein the diaphragm further comprises a flange extending radially and outwardly from an outer peripheral edge of the external portion, the housing comprising a base plate and a sidewall on the base plate, the sidewall defining a receiving chamber therein, a step extending radially and inwardly from an inner peripheral surface of the sidewall, the flange of the diaphragm being attached to the step of the sidewall.

8. The micro-electroacoustic device as claimed in claim 7, further comprising a yoke, the yoke comprising a base wall and a side wall extending from an outer edge of the base wall, the yoke defining a receiving space therein, the base plate comprising the seat and two opposite arms extending outwardly from an outer peripheral surface of the seat to the sidewall of the housing, the seat defining a through hole therein, the yoke being received in the through hole of the seat, the side wall of the yoke resting on the protrusion of the seat, the through hole of the seat communicating with the receiving space of the yoke, the magnet resting on the base wall of the yoke.

* * * * *